US010580245B2

(12) United States Patent
Niizuma

(10) Patent No.: US 10,580,245 B2
(45) Date of Patent: Mar. 3, 2020

(54) COIN PROCESSING APPARATUS

(71) Applicant: FUJI ELECTRIC CO., LTD., Kawasaki-shi, Kanagawa (JP)

(72) Inventor: Nobuyuki Niizuma, Yokkaichi (JP)

(73) Assignee: FUJI ELECTRIC CO., LTD., Kawasaki-Shi, Kanagawa (JP)

( * ) Notice: Subject to any disclaimer, the term of this patent is extended or adjusted under 35 U.S.C. 154(b) by 0 days.

(21) Appl. No.: 15/986,194

(22) Filed: May 22, 2018

(65) Prior Publication Data

US 2019/0005757 A1 Jan. 3, 2019

(30) Foreign Application Priority Data

Jun. 29, 2017 (JP) ..... 2017-127187

(51) Int. Cl.
*G07D 5/02* (2006.01)
*G07D 9/00* (2006.01)
*G07D 1/02* (2006.01)

(52) U.S. Cl.
CPC ..... *G07D 5/02* (2013.01); *G07D 9/002* (2013.01); *G07D 1/02* (2013.01); *G07D 2201/00* (2013.01); *G07D 2205/00* (2013.01)

(58) Field of Classification Search
CPC ..... G07D 1/02; G07D 5/02; G07D 9/002; G07D 2201/00; G07D 2205/00
See application file for complete search history.

(56) References Cited

U.S. PATENT DOCUMENTS 5,662,205 A * 9/1997 Levasseur ..... G07D 5/00 194/317
6,003,652 A * 12/1999 Murata ..... G07D 1/00 194/206
2017/0206726 A1* 7/2017 Sato ..... G07D 5/02

FOREIGN PATENT DOCUMENTS

JP H07-200912 A 8/1995
JP 2007-164752 A 6/2007

* cited by examiner

*Primary Examiner* — Mark J Beauchaine
(74) *Attorney, Agent, or Firm* — Manabu Kanesaka

(57) ABSTRACT

A coin processing apparatus includes: a slit provided on a downstream-side conveyance path or at an entry of the downstream-side conveyance path in a coin drawing section for a storage to pass a coin having a coin diameter equal to or less than a diameter of a target type of coin to be drawn; a coin bias mechanism configured to bias a conveyed coin; an outer diameter sensor configured to detect whether a coin passing through the downstream-side conveyance path has an outer diameter of a target type of coin to be drawn; a material sensor configured to detect material of a coin passing through the downstream-side conveyance path; and a hole sensor that detects presence or absence of a hole of a coin passing through the downstream-side conveyance path.

4 Claims, 17 Drawing Sheets

FIG.13

| | | | 500-YEN STORAGE | 10-YEN STORAGE | 100-YEN STORAGE | 5-YEN STORAGE | 50-YEN STORAGE | 1-YEN STORAGE |
|---|---|---|---|---|---|---|---|---|
| CURRENT COINS TO BE DRAWN | | | 500-YEN NICKEL BRASS COINS 500-YEN CUPRONICKEL COINS 500-YEN BI-COLOR COINS | 10-YEN BRONZE COINS | 100-YEN CUPRONICKEL COINS 100-YEN CLAD COINS | 5-YEN BRASS COINS | 50-YEN CUPRONICKEL COINS | 1-YEN ALUMINUM COINS |
| DIAMETER (mm) | | | 26.5 | 23.5 | 22.6 | 22 | 21 | 20 |
| THICKNESS (mm) | | | 1.8 | 1.5 | 1.7 | 1.5 | 1.75 | 1.5 |
| PRESENCE OR ABSENCE OF HOLE | | | ABSENT | ABSENT | ABSENT | PRESENT | PRESENT | ABSENT |
| EXIT WIDTH (mm) (SLIT 2) | | | 28 | 24.7 | 24 | 23.2 | 22.4 | 21.2 |
| COINS TO BE DRAWN (COINS EQUAL TO OR LESS THAN EXIT WIDTH) | OUTER DIAMETER SENSOR | | 10-YEN BRONZE COINS 100-YEN CUPRONICKEL COINS 100-YEN CLAD COINS 5-YEN BRASS COINS 50-YEN CUPRONICKEL COINS 1-YEN ALUMINUM COINS | 5-YEN BRASS COINS 1-YEN ALUMINUM COINS | | | | |
| | MATERIAL/HOLE SENSOR | MATERIAL | FOR DETECTION OF PASSING OF SMALL-DIAMETER COINS | 100-YEN CUPRONICKEL COINS 100-YEN CLAD COINS 50-YEN CUPRONICKEL COINS | 5-YEN BRASS COINS 1-YEN ALUMINUM COINS 10-YEN BRONZE COINS | 50-YEN CUPRONICKEL COINS | 5-YEN BRASS COINS 1-YEN ALUMINUM COINS | 50-YEN CUPRONICKEL COINS |
| | | HOLE | | 5-YEN BRASS COINS | 50-YEN CUPRONICKEL COINS | 100-YEN CUPRONICKEL COINS 100-YEN CLAD COINS 10-YEN BRONZE COINS 1-YEN ALUMINUM COINS | | |

COIN PROCESSING APPARATUS

CROSS-REFERENCE TO RELATED APPLICATION(S)

The present application claims priority to and incorporates by reference the entire contents of Japanese Patent Application No. 2017-127187 filed in Japan on Jun. 29, 2017.

BACKGROUND

1. Technical Field

The present disclosure relates to a coin processing apparatus.

2. Related Art

In the related art, coin processing apparatuses used as for example change dispensers determine the authenticity and the type of coins that are dropped through a coin slot and then automatically takes coins that are determined to be current coins so as to store them in coin storages that are provided for respective types of coins. Furthermore, in accordance with a change drawing request from an external device, or the like, the coin processing apparatus draws the requested amount of coins, stored in the coin storages, as changes to a coin drawing port.

The coin processing apparatuses sometimes receive poor-quality coins. Even in such a case, some coin processing apparatuses are capable of drawing changes in an accurate and stable manner by performing a coin-drawing determination process while focusing attention to the difference in material between coins (see Japanese Laid-open Patent Publication No. 7-200912 and Japanese Laid-open Patent Publication No. 2007-164752).

SUMMARY

Furthermore, in recent years, instead of casher-staffed checkout, there has been wide use of self checkout for customers to register products and receive and disburse money and semi-self checkout for customers to only receive and disburse money. With this type of self-service money processing apparatuses, as ordinary persons handle coin processing apparatuses, entry of foreign matters, or the like, occurs more often than before and a sorting mechanism in the coin processing apparatus is sometimes jammed due to foreign matters. In this case, coins are sometimes mistakenly delivered to a coin storage for a different type of coins with the same material. For this reason, checking only the material of coins does not make it possible to determine different types of coins with a high accuracy when coins are drawn from a coin storage. However, if a configuration is such that coins are drawn through a received-coins determining unit so as to make determination of drawn coins with the same degree of accuracy as for received coins, a conveying time becomes longer, and if a unit corresponding to the received-coins determining unit is provided in each storage, costs are increased and a processing time becomes longer; thus, it is difficult to draw coins at a high speed.

It is desirable to provide a coin processing apparatus that enables high-accuracy and high-speed determination of different types of coins with a simple configuration during coin drawing from coin storages.

It is an object of the disclosure to at least partially solve the problems in the conventional technology.

It is an object of the disclosure to at least partially solve the problems in the conventional technology.

In some embodiments, provided is a coin processing apparatus that determines authenticity and a type of a received coin, sorts a coin for each type of coin after holding a coin that is determined to be a current coin, stores the sorted coin, and draws the stored coin in accordance with a coin drawing command. The coin processing apparatus includes: a storage configured to store the sorted coin; a coin drawing section configured to deliver the stored coin in the storage and from which the stored coin is drawn in accordance with the coin drawing command; a slit provided on a downstream-side conveyance path or at an entry of the downstream-side conveyance path in the coin drawing section for the storage to pass a coin having a coin diameter equal to or less than a diameter of a target type of coin to be drawn, stored in the storage; a coin bias mechanism configured to bias a conveyed coin in one radial direction perpendicular to a conveying direction on the downstream-side conveyance path of the coin drawing section; an outer diameter sensor configured to detect whether a coin passing through the downstream-side conveyance path has an outer diameter of a target type of coin to be drawn; a material sensor configured to detect material of a coin passing through the downstream-side conveyance path; and a hole sensor that detects presence or absence of a hole of a coin passing through the downstream-side conveyance path. A coin having an outer diameter larger than a diameter of a target type of coin to be drawn is determined not to be a target type of coin to be drawn, based on a stop of the coin at the entry of the slit, and it is determined whether the coin passing through the slit is a target type of coin to be drawn depending on whether the coin has an outer diameter of the target type of coin to be drawn, material, and presence or absence of a hole.

The above and other objects, features, advantages and technical and industrial significance of this disclosure will be better understood by reading the following detailed description of presently preferred embodiments of the disclosure, when considered in connection with the accompanying drawings.

BRIEF DESCRIPTION OF THE DRAWINGS

FIG. 13 is a diagram that illustrates the details of a coin-drawing determination process by each coin storage;

DETAILED DESCRIPTION

With reference to attached drawings, an explanation is given below of an embodiment for implementing the disclosure.

Outline of a Coin Processing Apparatus

Figure 1:
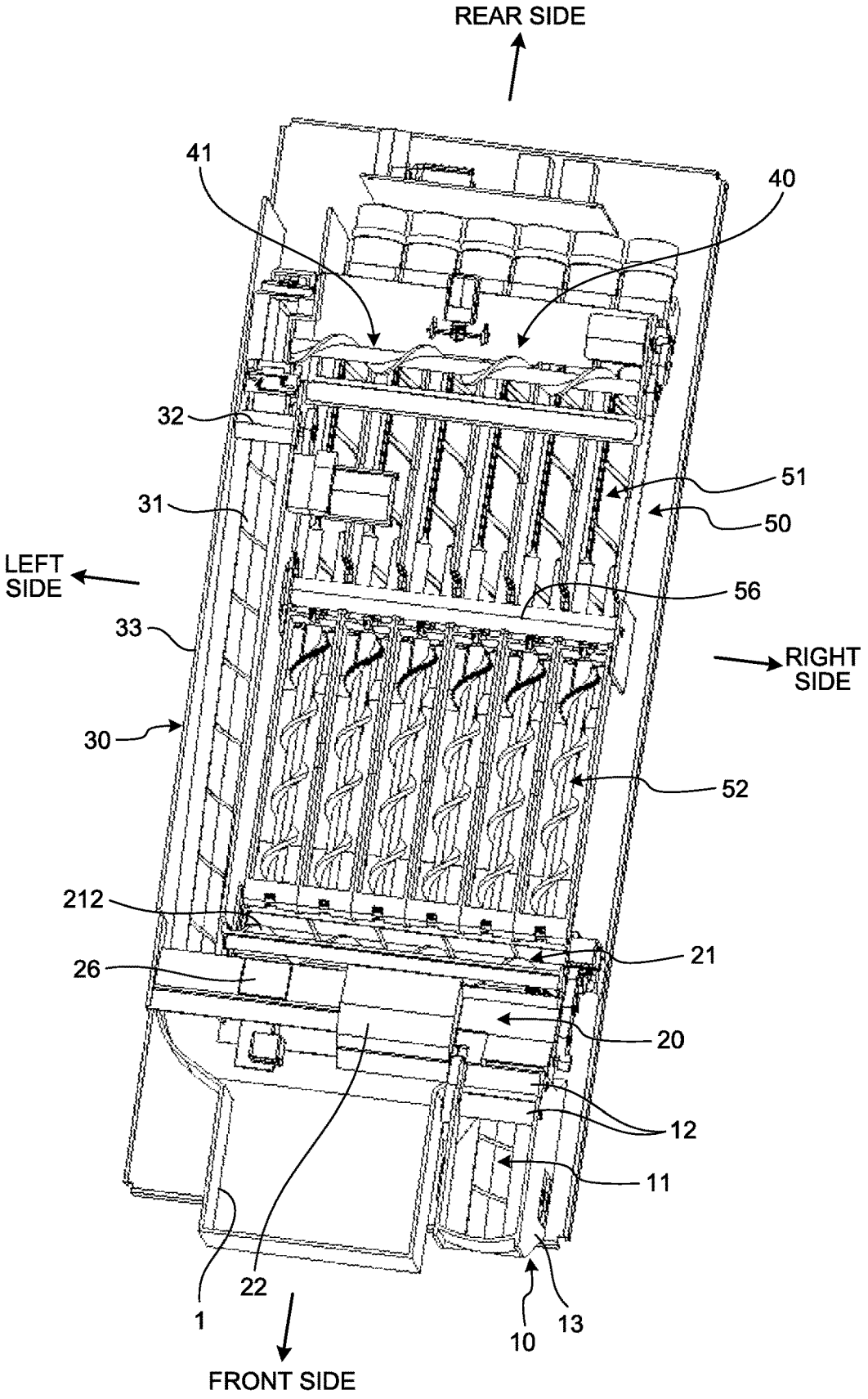
FIG. 1 is a perspective view that illustrates the internal structure of a coin processing apparatus according to an embodiment of the disclosure.

FIG. 1 is a perspective view that illustrates the internal structure of a coin processing apparatus according to an embodiment of the disclosure. The coin processing apparatus illustrated here is used as, for example, a change dispenser, and it is configured such that it includes a received-coin conveying section 10, a coin checking section 20, a temporarily holding section 30, a coin sorting section 40, and a coin storage section 50.

Figure 2:
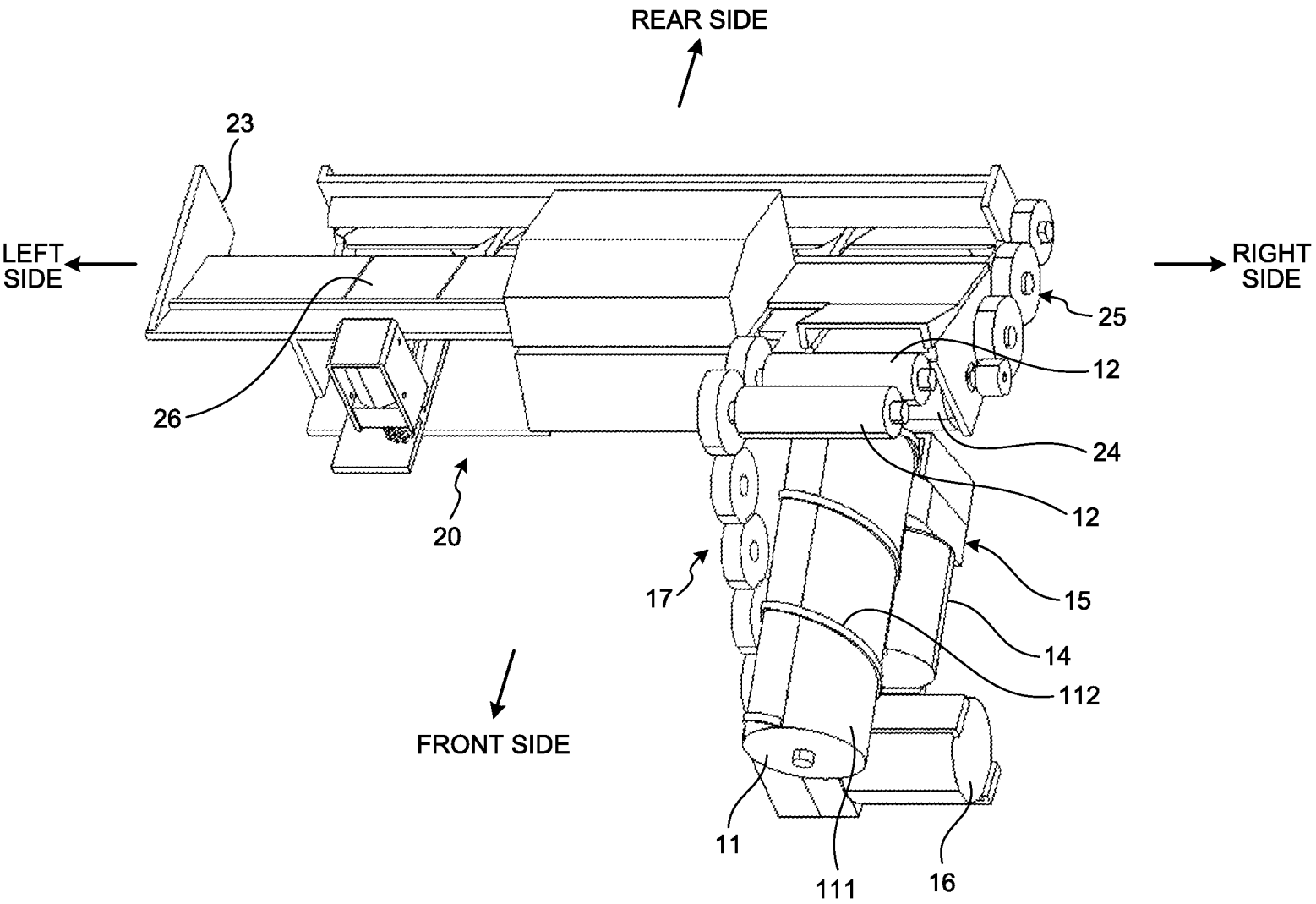
FIG. 2 is a perspective view that illustrates the relevant parts of a received-coin conveying section and a coin checking section, illustrated in FIG. 1, in an enlarged manner.

FIG. 2 is a perspective view that illustrates the relevant parts of the received-coin conveying section 10 and the coin checking section 20, illustrated in FIG. 1, in an enlarged manner. The received-coin conveying section 10 conveys coins that are dropped through an undepicted coin slot. The received-coin conveying section 10 includes a received-coin screw-type conveying member 11 and a received-coin reverse roller 12.

The received-coin screw-type conveying member 11 is configured such that a received-coin blade section 112 protruding in a radial direction is provided in a helical fashion on the outer circumference of a received-coin shaft section 111 having a cylindrical shape and extending in a front-back direction. The received-coin screw-type conveying member 11 is provided on a received-coin guide 13 (see FIG. 1) in such a manner that it gradually slopes upward as it is closer to the rear.

The received-coin screw-type conveying member 11 is connected to a motor 14 via a connection member 15, and it is rotated around the central axis of the received-coin shaft section 111 when the motor 14 is driven. Specifically, when the received-coin screw-type conveying member 11 is rotated around the central axis of the received-coin shaft section 111, it conveys coins from the front to the rear in an accumulated manner, and the rear side is a downstream side in a conveying direction.

The multiple (two in the illustrated example) received-coin reverse rollers 12 are provided, and each of them extends in a right-and-left direction perpendicular to the received-coin shaft section 111 on the top of the rear side (the downstream side in the conveying direction) of the received-coin screw-type conveying member 11. The received-coin reverse roller 12 is connected to a common motor 16 via a connection member 17, and it is rotated around its own axis when the motor 16 is driven.

Each of the above received-coin reverse rollers 12 is rotated around its own axis so that it is brought into contact with coins, conveyed by the received-coin screw-type conveying member 11, whereby coins are conveyed in such a manner that they are stored one by one in the pitch that is formed by the received-coin blade section 112 of the received-coin screw-type conveying member 11. Here, according to the present embodiment, the pitch formed by the received-coin blade section 112 is the interval between the adjacent received-coin blade sections 112 when the received-coin screw-type conveying member 11 is viewed from the top, and it has such a size that multiple coins with the smallest diameter do not fit into it.

With the received-coin conveying section 10 that has the above-described configuration, it is possible to convey coins to the coin checking section 20 one by one after being dropped through the coin slot.

The coin checking section 20 determines the authenticity and the type of a coin, conveyed through the received-coin conveying section 10 one by one. The coin checking section 20 includes a coin-checking screw-type conveying member 21 and a determining section 22.

The coin-checking screw-type conveying member 21 is configured such that a coin-checking blade section 212 (see FIG. 1) protruding in a radial direction is provided in a helical fashion on the outer circumference of a coin-checking shaft section (not illustrated) having a cylindrical shape and extending in a right-and-left direction. The coin-checking screw-type conveying member 21 is provided on a coin checking guide 23 in such a manner that it is substantially horizontal.

The coin-checking screw-type conveying member 21 is connected to a motor 24 via a connection member 25, and it is rotated around the central axis of the coin-checking shaft section when the motor 24 is driven. Specifically, when the coin-checking screw-type conveying member 21 is rotated around the central axis of the coin-checking shaft section, it conveys a coin from the right to the left one by one, and the left side is a downstream side in the conveying direction.

The determining section 22 is provided in the middle of the coin-checking screw-type conveying member 21. The determining section 22 determines the authenticity and the type of the coin that is conveyed by the coin-checking screw-type conveying member 21 one by one. If a coin is determined to be "fake" by the determining section 22, it is delivered to a coin drawing port 1 (see FIG. 1) by operating a reject gate 26 provided in the coin checking guide 23.

With the coin checking section 20 that has the above-described configuration, the authenticity and the type of the coin individually conveyed by the received-coin conveying section 10 are determined so that the coin that is determined to be "fake" is delivered to the coin drawing port 1 by operating the reject gate 26 while the coin that is determined to be "authentic" may be conveyed to the temporarily holding section 30.

Figure 3:
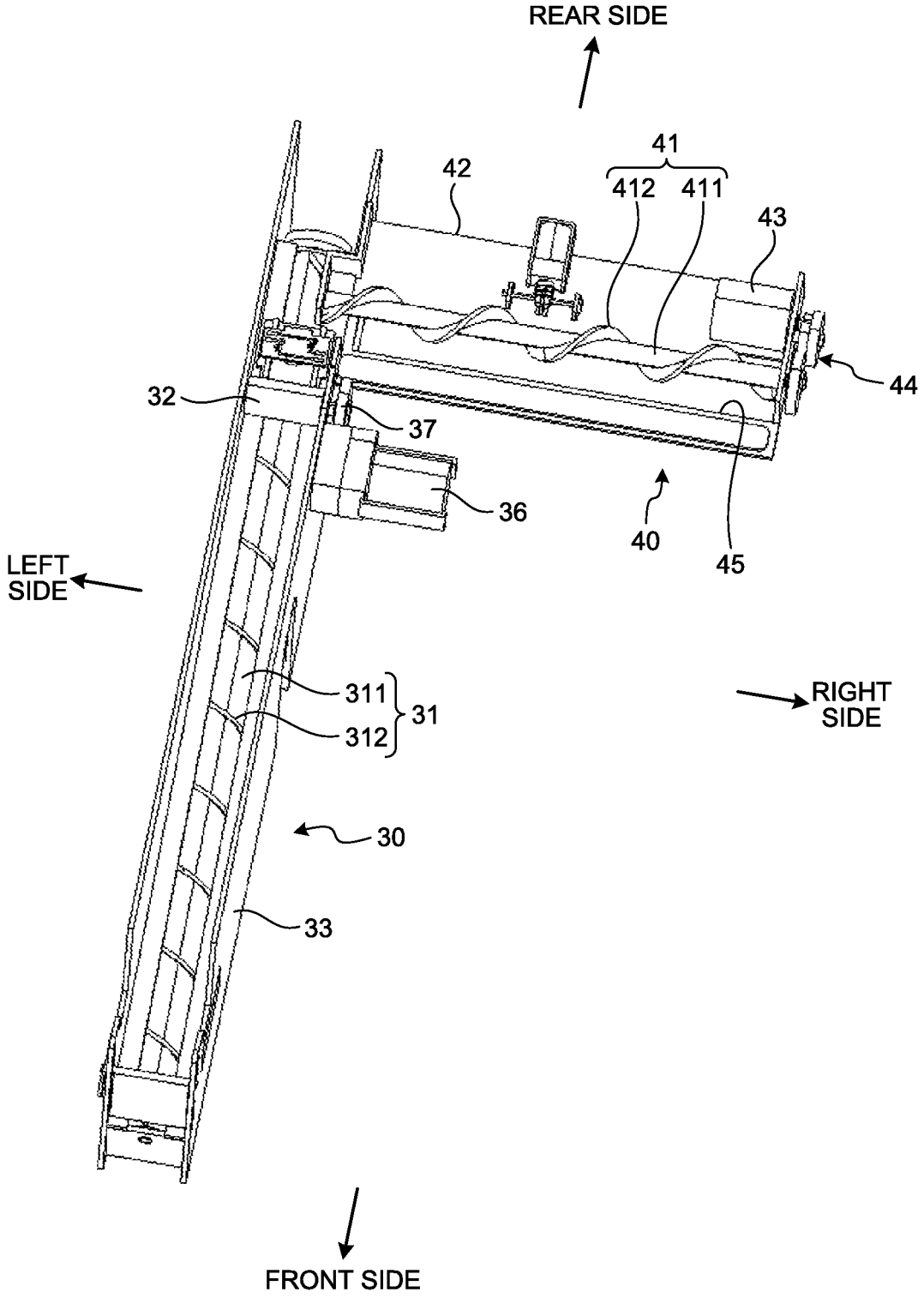
FIG. 3 is a perspective view that illustrates the relevant parts of a temporarily holding section and a coin sorting section, illustrated in FIG. 1, in an enlarged manner.

FIG. 3 is a perspective view that illustrates the relevant parts of the temporarily holding section 30 and the coin sorting section 40, illustrated in FIG. 1, in an enlarged manner. The temporarily holding section 30 temporarily holds the coin that is determined to be "authentic" by the coin checking section 20. The temporarily holding section 30 includes a holding screw-type conveying member 31 and a holding reverse roller 32.

Figure 4:
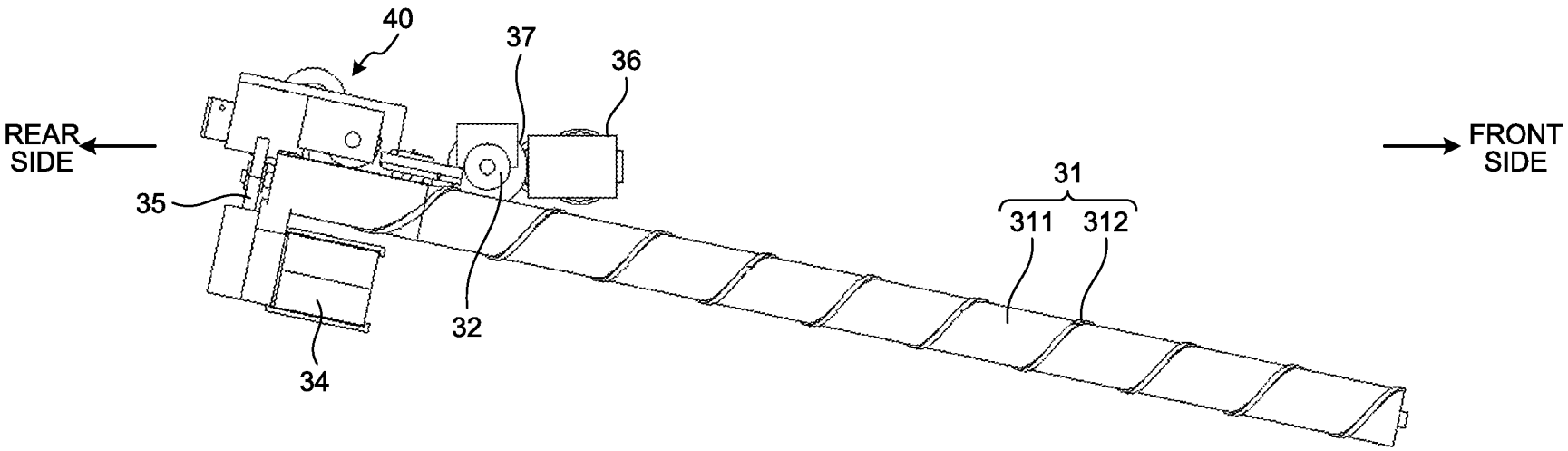
FIG. 4 is an explanatory diagram that schematically illustrates primary components of the temporarily holding section illustrated in FIG. 3.

The holding screw-type conveying member 31 is configured such that a holding blade section 312 protruding in a radial direction is provided in a helical fashion on the outer circumference of a holding shaft section 311 having a cylindrical shape and extending in a front-back direction. As illustrated in FIG. 4, the holding screw-type conveying member 31 is provided in a holding guide 33 in such a manner that it gradually slopes upward as it is closer to the rear.

The holding screw-type conveying member 31 is connected to a motor 34 via a connection member 35, and it is rotated around the central axis of the holding shaft section 311 when the motor 34 is driven. Specifically, when the holding screw-type conveying member 31 is rotated around the central axis of the holding shaft section 311, it conveys coins in an accumulated manner from the front to the rear, and the rear side is a downstream side in the conveying direction.

The holding reverse roller 32 extends in a right-and-left direction perpendicular to the holding shaft section 311 on the top of the rear side (the downstream side in the conveying direction) of the holding screw-type conveying member 31. The holding reverse roller 32 is connected to a motor 36 via a connection member 37, and it is rotated around its own axis when the motor 36 is driven.

The holding reverse roller 32 is rotated around its own axis so that it is brought into contact with coins conveyed by the holding screw-type conveying member 31, whereby the coins are conveyed in such a manner that they are stored one by one in the pitch that is formed by the holding blade section 312 of the holding screw-type conveying member 31. Here, according to the present embodiment, the pitch formed by the holding blade section 312 is the interval between the adjacent holding blade sections 312 when the holding screw-type conveying member 31 is viewed from the top, and it has such a size that multiple coins with the smallest diameter do not fit into it.

With the temporarily holding section 30 that has the above-described configuration, the coin that is determined to be "authentic" by the coin checking section 20 may be held in an upper area of the holding screw-type conveying member 31 if the holding screw-type conveying member 31 is not operated, while the temporarily held coin may be conveyed to the coin sorting section 40 one by one if the holding screw-type conveying member 31 is operated.

The coin sorting section 40 sorts the coins, conveyed one by one through the temporarily holding section 30, for each type of coin. The coin sorting section 40 includes a sorting screw-type conveying member 41.

The sorting screw-type conveying member 41 is configured such that a sorting blade section 412 protruding in a radial direction is provided in a helical fashion on the outer circumference of a sorting shaft section 411 having a cylindrical shape and extending in a right-and-left direction. The sorting screw-type conveying member 41 is provided in a sorting guide 42 in such a manner that it is substantially horizontal.

The sorting screw-type conveying member 41 is connected to a motor 43 via a connection member 44, and it is rotated around the central axis of the sorting shaft section 411 when the motor 43 is driven. Specifically, when the sorting screw-type conveying member 41 is rotated around the central axis of the sorting shaft section 411, it conveys coins one by one from the left to the right in such a manner that it slides on the bottom surface of the sorting guide 42, and the right side is a downstream side in the conveying direction. Here, a sorting hole 45, whose hole area increases from the left to the right, is formed on the bottom surface of the sorting guide 42.

With the coin sorting section 40 that has the above-described configuration, the coin individually conveyed by the temporarily holding section 30 is conveyed from the left to the right and, in the middle of conveyance, it may be sorted to the coin storage section 50 through the sorting hole 45 for each type of coin.

Figure 5:
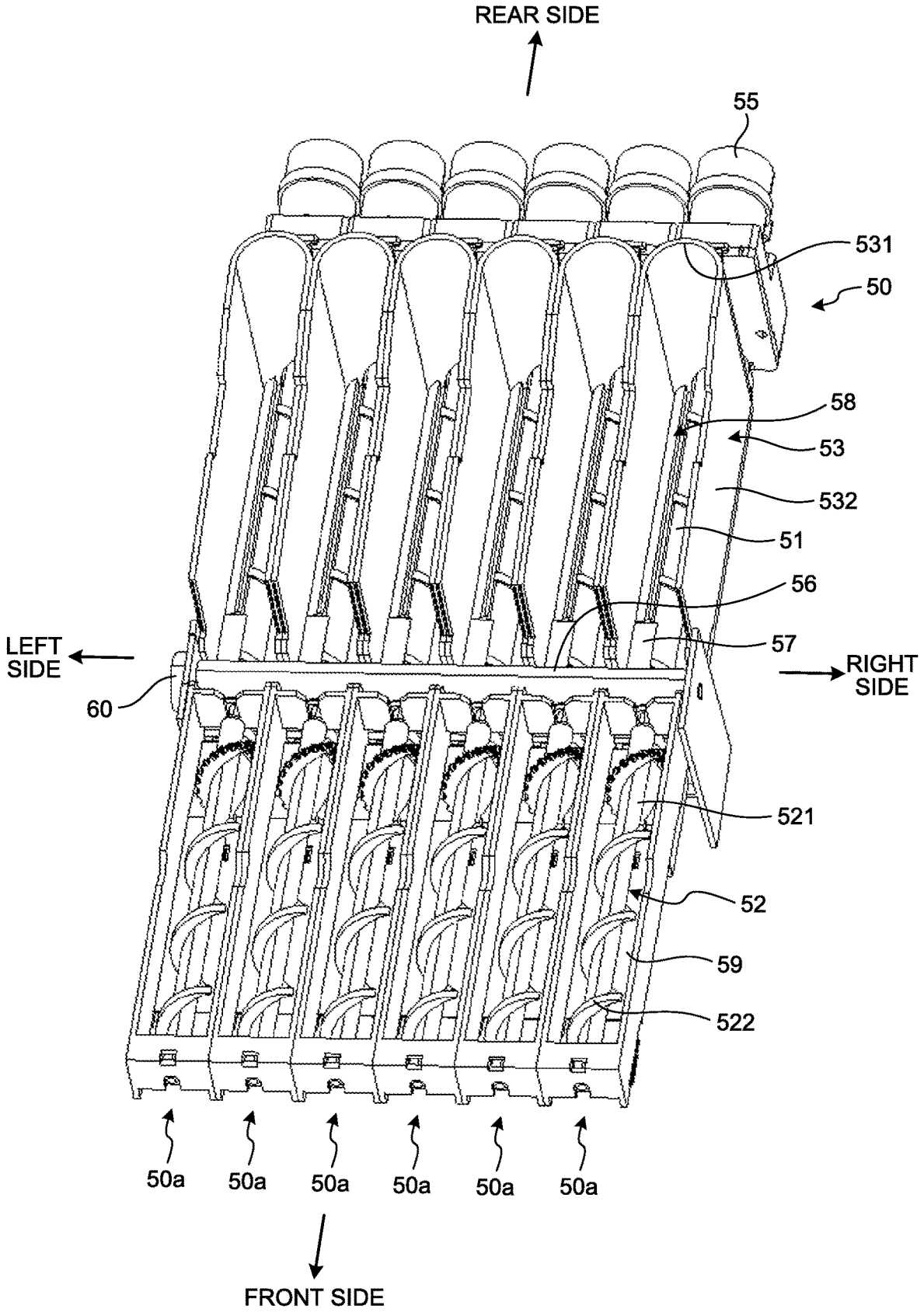
FIG. 5 is a perspective view that illustrates a coin storage section illustrated in FIG. 1.

FIG. 5 is a perspective view that illustrates the coin storage section 50 illustrated in FIG. 1. The coin storage section 50 is configured such that multiple (six in the illustrated example) coin storages 50*a* are arranged side by side in a horizontal direction. Specifically, the coin storage section 50 is configured such that the coin storages 50*a*, storing for example 1-yen coins, 50-yen coins, 5-yen coins, 100-yen coins, 10-yen coins, and 500-yen coins, are arranged side by side in a horizontal direction. The coin storages 50*a* included in the coin storage section 50 have the same configuration except that their lengths in the right-and-left direction are different. Therefore, hereafter, an explanation is given of the coin storage 50*a* for 500-yen coins, located on the rightmost side, and explanations for the other coin storages 50*a* are omitted.

Figure 6:
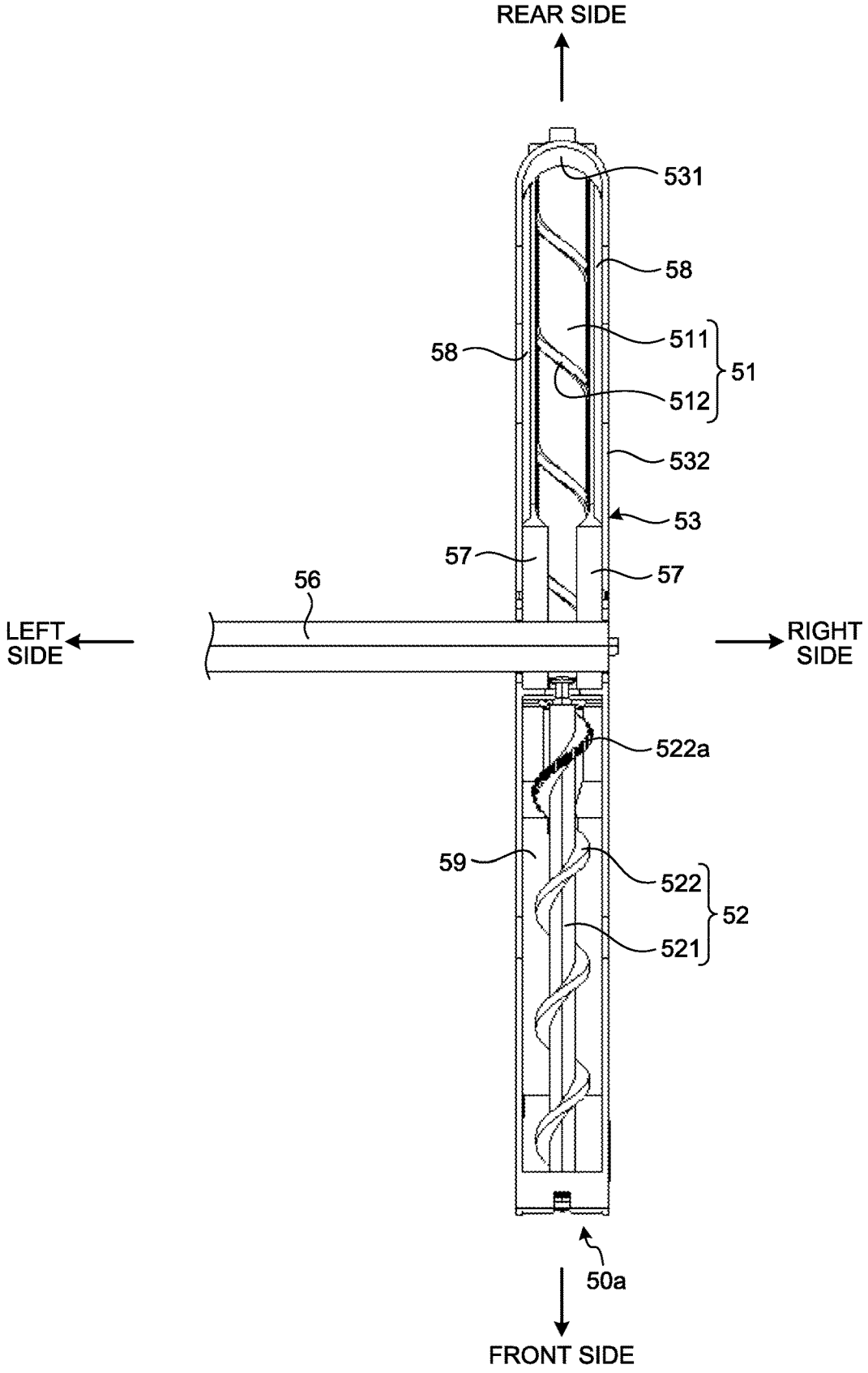
FIG. 6 is a plan view that illustrates the relevant part of a coin storage that is located on the rightmost side, illustrated in FIG. 5.
Figure 7:
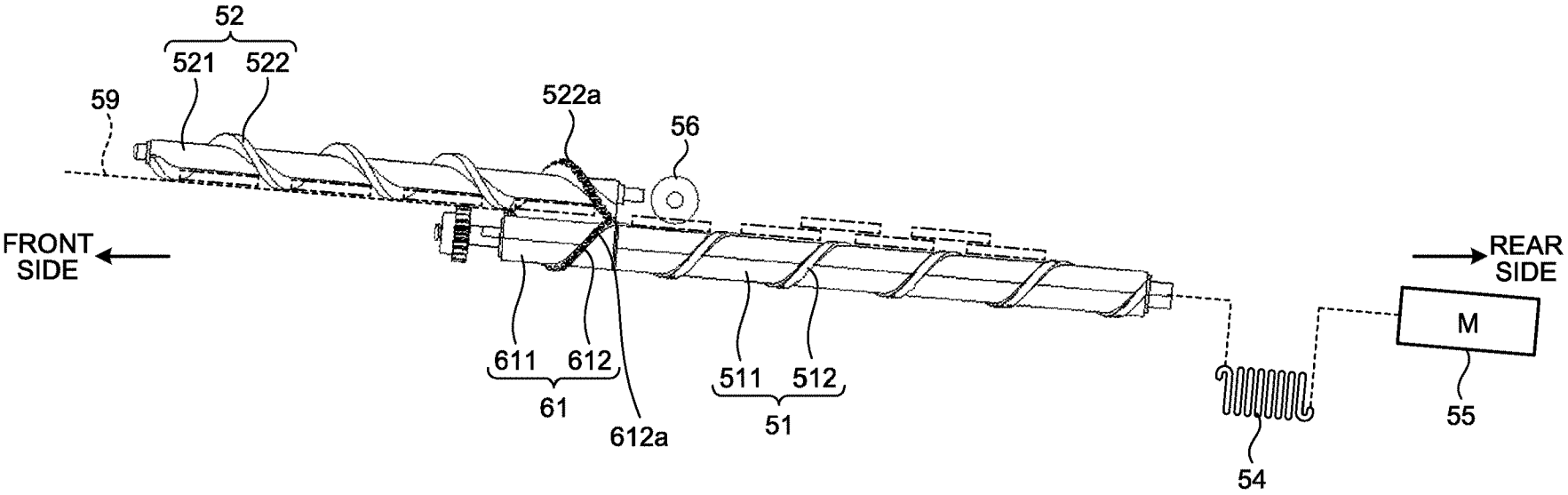
FIG. 7 is an explanatory diagram that schematically illustrates principal components of the coin storage that is located on the rightmost side, illustrated in FIG. 5.

FIG. 6 is a plan view that illustrates the relevant part of the coin storage 50*a* that is located on the rightmost side, illustrated in FIG. 5, and FIG. 7 is an explanatory diagram that schematically illustrates the principal components of the coin storage 50*a* that is located on the rightmost side, illustrated in FIG. 5. As also illustrated in FIGS. 6 and 7, the coin storage 50*a* includes a first storing screw-type conveying member (a first screw-type conveying member) 51 and a second storing screw-type conveying member (a second screw-type conveying member) 52.

The first storing screw-type conveying member 51 is configured such that a first storing blade section (a first blade section) 512 protruding in a radial direction is provided in a helical fashion on the outer circumference of a first storing shaft section (a first shaft section) 511 having a cylindrical shape and extending in a front-back direction.

As illustrated in FIG. 7, the first storing screw-type conveying member 51 is provided in a storage guide 53 in such a manner that it gradually slopes upward as it is closer to the front. The rear edge of the first storing screw-type conveying member 51 is connected to a motor 55 via a storage spring 54 by passing through a cutout 531*a* (see FIG. 9) that is formed on a rear section 531 of the storage guide 53. Here, the storage spring 54 is a bias unit that biases the first storing screw-type conveying member 51 to the front.

The above-described first storing screw-type conveying member 51 is rotated around the central axis of the first storing shaft section 511 when the motor 55 is driven. Specifically, the first storing screw-type conveying member 51 is rotated in one direction (e.g., in a clockwise direction when viewed from the rear side) or in the opposite direction (e.g., in a counterclockwise direction when viewed from the rear side) around the central axis of the first storing shaft section 511.

Furthermore, when the first storing screw-type conveying member 51 is rotated in one direction around the central axis of the first storing shaft section 511, it conveys coins from the rear to the front in an accumulated manner, and the front side is a downstream side in a conveying direction. Conversely, when it is rotated in the opposite direction around the central axis of the first storing shaft section 511, it moves coins from the front to the rear.

Figure 8:
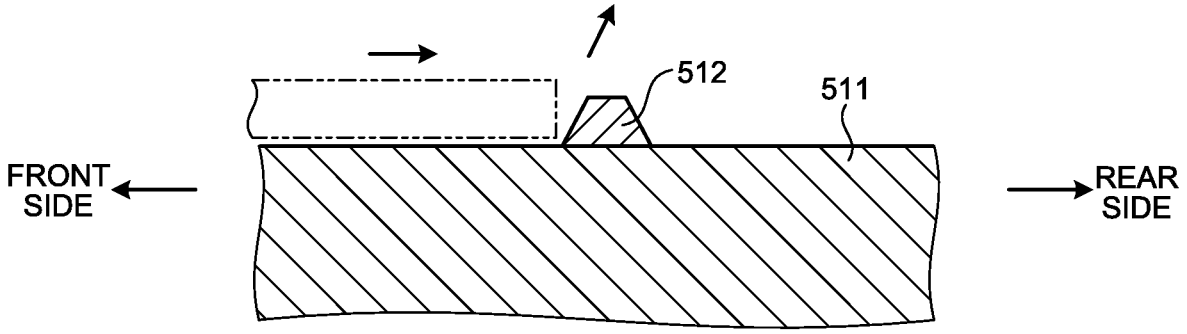
FIG. 8 is an enlarged cross-sectional view that illustrates the relevant part of a first storing screw-type conveying member illustrated in FIGS. 6 and 7.

With the above-described first storing screw-type conveying member 51, as illustrated in FIG. 8, the first storing blade section 512 has a trapezoidal shape as a vertical cross-sectional shape along the central axis of the first storing shaft section 511. Specifically, the first storing blade section 512 is formed in such a manner that the surface (front surface) facing the downstream side in the conveying direction gradually slopes toward the upstream side (the rear side) in the conveying direction as it is closer to the above, and it is formed in such a manner that the surface (the rear surface) facing the upstream side in the conveying direction gradually slopes toward the downstream side (the front side) in the conveying direction as it is closer to the above. Moreover, the height of protrusion of the first storing blade section 512 from the outer circumference of the first storing shaft section 511 in the radial direction is less than the thickness of the target coin (e.g., a 500-yen coin).

The above-described storage guide 53 is shaped like a case that extends in a front-back direction and that has an opening on the upper section and on the lower section. As illustrated in FIG. 6, the rear section 531 of the storage guide 53 is curved in such a manner that the front central part has a recess. The storage guide 53 supports a storage reverse roller 56, and it has a first conveying section 57, a second conveying section 58, and a guide section 59 formed therein.

The storage reverse roller 56 extends in a right-and-left direction in such a manner that it crosses each of the coin storages 50*a*, and it is supported by the storage guide 53 by entering recessed portions 532*a* that are formed on both lateral parts 532 in pair on the right and left of the storage guide 53. Here, as the recessed portions 532*a*, formed on the both lateral parts 532 of the storage guide 53, are formed in the upper area of the front edge of the first storing screw-type conveying member 51, the storage reverse roller 56 is supported by extending in the right-and-left direction perpendicular to the first storing shaft section 511 on the top of the front side (the downstream side in the conveying direction) of the first storing screw-type conveying member 51. The storage reverse roller 56 is connected to an undepicted motor via a connection member 60, and it is rotated around its own axis when the motor is driven.

The above-described storage reverse roller 56 is rotated around its own axis so that it is brought into contact with coins conveyed by the first storing screw-type conveying member 51 whereby the coins are stored one by one in the pitch that is formed by the first storing blade section 512 of the first storing screw-type conveying member 51. Here, according to the present embodiment, the pitch formed by the first storing blade section 512 is the interval between the adjacent first storing blade sections 512 when the first storing screw-type conveying member 51 is viewed from the top, and it has such a size that multiple target coins do not fit into it.

Figure 9:
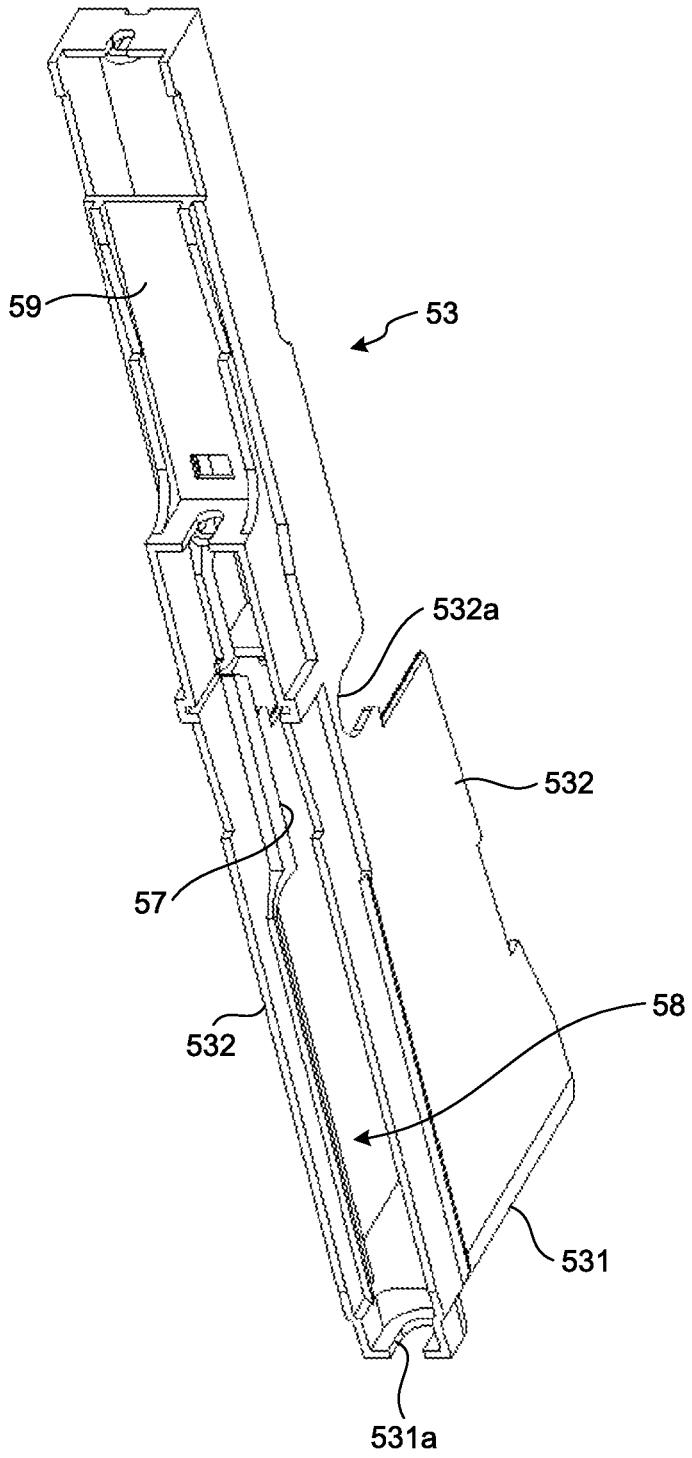
FIG. 9 is a perspective view of a storage guide illustrated in FIG. 6.
Figure 10:
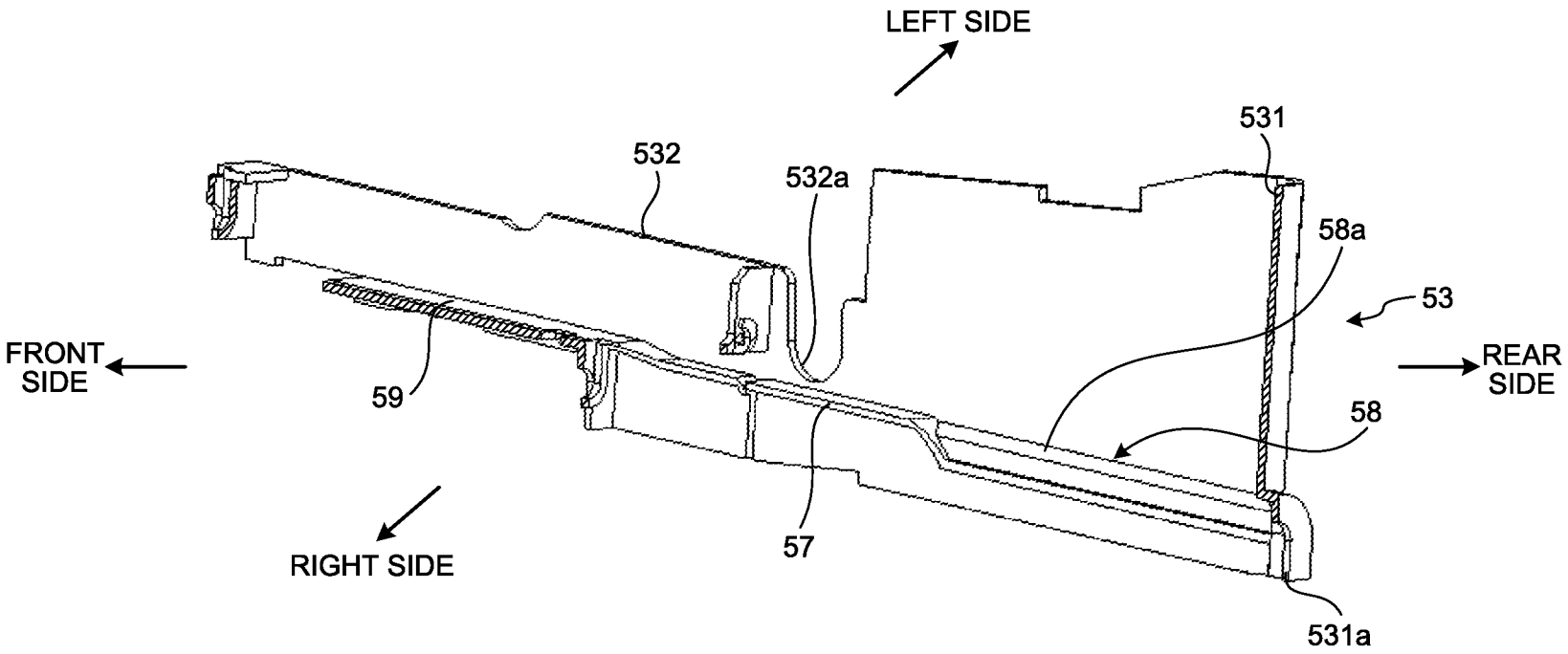
FIG. 10 is a cross-sectional view of the storage guide illustrated in FIG. 9.

As illustrated in FIGS. 6, 9, and 10, the first conveying sections 57 are formed in such a manner that they make a pair on the right and left under the storage reverse roller 56 at the both lateral parts 532 of the storage guide 53. The first conveying sections 57 extend in the extending direction of the first storing shaft section 511, and, more specifically, it extends in such a manner that it gradually slopes upward as it is closer to the front.

Figure 11:
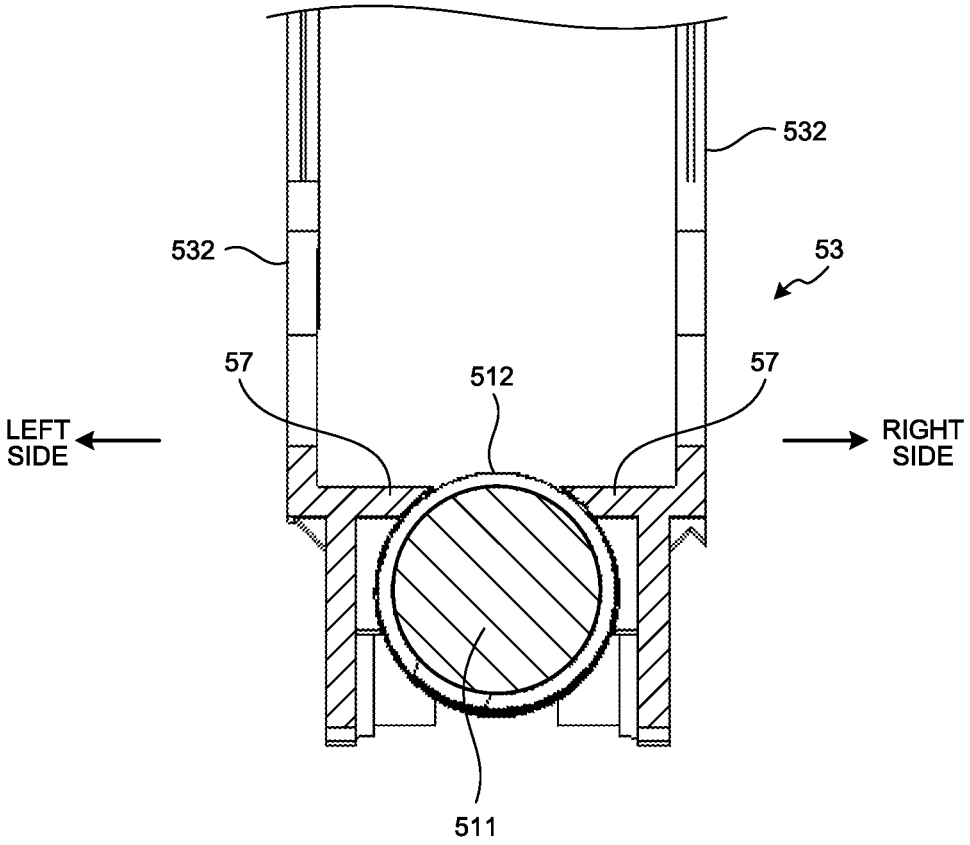
FIG. 11 is an explanatory diagram that illustrates the relation between a first conveying section and the first storing screw-type conveying member, illustrated in FIGS. 9 and 10.

As illustrated in FIG. 11, the above-described first conveying section 57 is provided such that the upper surface thereof is located above the upper section of the first storing shaft section 511 and under the first storing blade section 512.

The second conveying sections 58 are formed in such a manner that they make a pair on the right and left in the area that is posterior to the first conveying section 57 at the both lateral parts 532 of the storage guide 53 and that is opposed to the first storing screw-type conveying member 51. The second conveying sections 58 have a slope surface 58*a* that extends in such a manner that it gradually comes closer to the first storing screw-type conveying member 51 as it is closer to the below.

The guide section 59 is a flat-plate like section that connects the both lateral parts 532 of the storage guide 53 to each other in front of the first conveying section 57. As is the case with the above-described first conveying section 57, the guide section 59 is configured in such a manner that the upper surface thereof gradually slopes upward as it is closer to the front.

The second storing screw-type conveying member 52 is configured such that a second storing blade section (a second blade section) 522 protruding in a radial direction is provided in a helical fashion on the outer circumference of a second storing shaft section (a second shaft section) 521 having a cylindrical shape and extending in a front-back direction.

The second storing screw-type conveying member 52 is provided above the guide section 59 in such a manner that it gradually slopes upward as it is closer to the front. In the second storing screw-type conveying member 52, part of a gear 522*a*, formed on the edge surface of the rear edge of the second storing blade section 522, is engaged with an engagement member (engagement unit) 61 that is attached to the front edge of the first storing screw-type conveying member 51. Here, an explanation is first given of the engagement member 61.

The engagement member 61 is attached to the front edge of the first storing shaft section 511 included in the first screw-type conveying member 51, and it is configured such that an engagement blade section 612 protruding in a radial direction is provided in a helical fashion on the outer circumference of a cylindrical engagement shaft section 611. A gear 612*a* is formed on the edge surface of the engagement blade section 612, and the rear edge is connected to the front edge of the first storing blade section 512. Part of the gear 612*a* of the engagement blade section 612 of the engagement member 61 is engaged with part of the gear 522*a* of the rear edge of the second storing blade section 522.

When the first storing screw-type conveying member 51 is rotated around the central axis of the first storing shaft section 511 in one direction, the above-described engagement member 61 is integrally rotated with the first storing screw-type conveying member 51 so as to transmit the rotative force to the second storing screw-type conveying member 52, whereby the second storing screw-type conveying member 52 is rotated in the same direction as that of the first storing screw-type conveying member 51.

Conversely, when the first storing screw-type conveying member 51 is rotated in the opposite direction around the central axis of the first storing shaft section 511, the engagement member 61 is not rotated so as to limit transmission of the rotative force to the second storing screw-type conveying member 52. That is, the engagement member 61 functions as a one-way clutch between the first storing screw-type conveying member 51 and the second storing screw-type conveying member 52.

In the coin storage 50*a* that has the above-described configuration, when the above-described first storing screw-type conveying member 51 is rotated in one direction around the central axis of the first storing shaft section 511, it conveys coins from the rear to the front in an accumulated manner.

Then, when the above-described second storing screw-type conveying member 52 is rotated around the central axis of the second storing shaft section 521, the coins conveyed via the first storing screw-type conveying member 51 and the engagement member 61 are stored one by one in the pitch formed by the second storing blade section 522 of the second storing screw-type conveying member 52 on the upper surface of the guide section 59. Here, according to the present embodiment, the pitch formed by the second storing blade section 522 is the interval between the adjacent second storing blade sections 522 when the second storing screw-type conveying member 52 is viewed from beneath, and it has such a size that multiple target coins do not fit into it.

Then, in the above-described coin storage 50*a*, while the coin is stored in the foremost pitch formed by the second storing blade section 522, the second storing screw-type conveying member 52 is rotated 360 degrees in one direction around the central axis of the second storing shaft section 521 so that the coin stored in the foremost pitch is delivered to the front one by one, whereby it may be sent to the coin drawing port 1.

With the coin processing apparatus that has the above-described configuration, in the received-coin conveying section 10, the coin checking section 20, the temporarily holding section 30, the coin sorting section 40, and the coin storage section 50, a conveying unit that conveys coins is constituted of the received-coin screw-type conveying member 11, or the like, on which the received-coin blade section 112, or the like, protruding in a radial direction is provided in a helical fashion on the outer circumference of the cylindrical received-coin shaft section 111, or the like. Furthermore, the coins may be conveyed when the received-coin screw-type conveying member 11, or the like, is rotated around the central axis of the received-coin shaft section 111, or the like, whereby it is possible to prevent the occurrence of conveyance failures, such as a reduction in the conveyance force due to contamination, or the like, caused by conveyed coins, or an occurrence of tilted rotation. Therefore, coins may be conveyed in a desirable manner while a reduction in the conveyance force, an occurrence of tilted rotation, or the like, is prevented.

In the above-described coin processing apparatus, the first storing screw-type conveying member 51 is rotated in the opposite direction around the central axis of the first storing shaft section 511 so that accumulated coins may be moved to the rear; therefore, the pile formed due to accumulation of coins may be broken by bringing a part of accumulated coins into contact with the front surface of the rear section 531 of the storage guide 53. Furthermore, as described above, as the front central part of the rear section 531 of the storage guide 53 is curved in such a manner that it has a recess, it may be ensured that the coin abutting the rear section 531 is in a laid-over position on its side, and it is possible to prevent coins from being brought into contact with the rear section 531 and being held in a standing position. Therefore, coins may be conveyed in a desirable manner.

In the above-described coin processing apparatus, the second conveying section 58 of the storage guide 53 has the slope surface 58*a* extending in such a manner that it gradually comes closer to the first storing screw-type conveying member 51 as it is closer to the below; therefore, coins may be prevented from being held in a standing position in the gap between the first storing screw-type conveying member 51 and the both lateral parts 532 of the storage guide 53. Thus, the coins may be conveyed in a desirable manner.

In the above-described coin processing apparatus, the first conveying section 57 of the storage guide 53 is provided under the storage reverse roller 56 such that it extends in the extending direction of the first storing shaft section 511, whereby the passing performance of coins may be improved and thus coins may be conveyed in a desirable manner. Furthermore, it is provided such that the upper surface of the first conveying section 57 is located above the upper section of the first storing shaft section 511 and under the first storing blade section 512; thus, the passing performance of coins may be improved, and coins may be conveyed in a desirable manner.

In the above-described coin processing apparatus, the height of protrusion of the first storing blade section 512 of the first storing screw-type conveying member 51 from the outer circumference of the first storing shaft section 511 in the radial direction is less than the thickness of the target coin (e.g., a 500-yen coin); therefore, coins may be prevented from being stuck in the pitch formed by the first storing blade section 512, and thus coins may be conveyed in a desirable manner.

In the above-described coin processing apparatus, the first storing blade section 512 of the first storing screw-type conveying member 51 has a trapezoidal shape as a vertical cross-sectional shape along the central axis of the first storing shaft section 511; therefore, if it is pushed by a coin in the direction opposite to the conveying direction, the coin may be moved obliquely upward to the side opposite to the conveying direction, whereby it is possible to prevent the occurrence of lock due to a coin jam.

In the above-described coin processing apparatus, the rear edge of the first storing screw-type conveying member 51 is connected to the motor 55 via the storage spring 54, which applies a bias to the front; therefore, if the force toward the side opposite to the conveying direction is increased due to a coin jam, or the like, while coins are conveyed, the first storing screw-type conveying member 51 may be displaced to the rear against the biasing force of the storage spring 54. Thus, it is possible to prevent the occurrence of lock due to a coin jam.

In the above-described coin processing apparatus, as coins are stored one by one in the pitch formed by the second storing blade section 522 of the second storing screw-type conveying member 52, coins are prepared to be drawn in a separated state. Thus, if a coin drawing command is given, the second storing screw-type conveying member 52 is rotated by only a predetermined number of times in one direction so that a predetermined number of coins may be drawn. That is, instead of separating and drawing stored coins in accordance with a coin drawing command in a conventional manner, only drawing may be conducted; thus, the time for drawing coins may be shortened.

In the above-described coin processing apparatus, the second storing screw-type conveying member 52 is rotated 360 degrees in one direction around the central axis of the second storing shaft section 521 so that the coin stored in the foremost pitch is delivered to the front one by one; therefore, if the number of rotations of the second storing screw-type conveying member 52 in one direction is controlled, the number of coins paid by the second storing screw-type conveying member 52 may be controlled.

In the above-described coin processing apparatus, when the first storing screw-type conveying member 51 is rotated in one direction around the central axis of the first storing shaft section 511, the engagement member 61 transmits the rotative force to the second storing screw-type conveying member 52 so that the second storing screw-type conveying member 52 is rotated in the same direction as that of the first storing screw-type conveying member 51 and, if the first storing screw-type conveying member 51 is rotated in the opposite direction around the central axis of the first storing shaft section 511, limits the transmission of the rotative force to the second storing screw-type conveying member 52, whereby it is possible to prevent the coins, stored in the second storing screw-type conveying member 52 one by one, from being conveyed to the rear.

Configuration of a Coin Drawing Section

Figure 12:
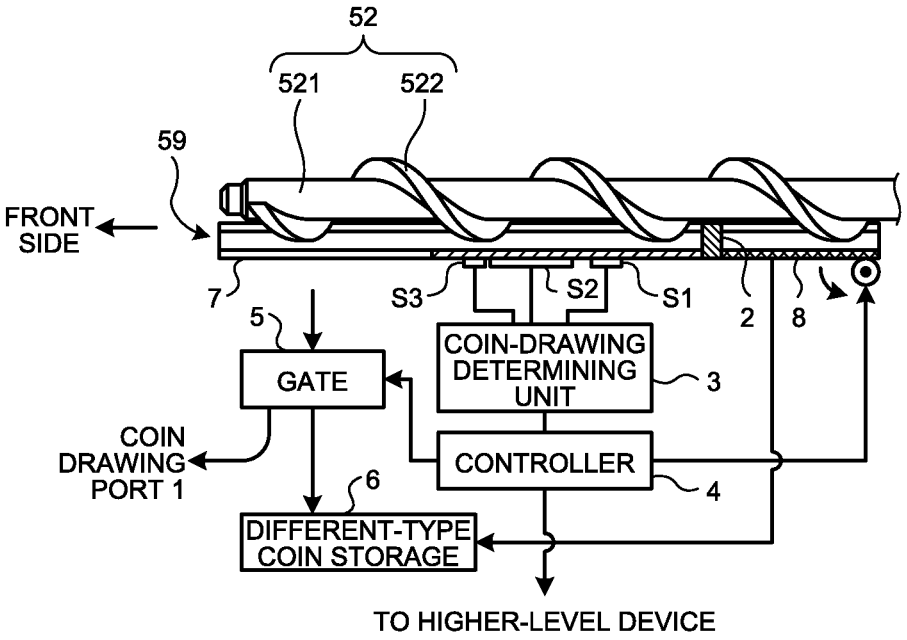
FIG. 12 is a schematic diagram that illustrates a configuration of a coin drawing section.

FIG. 12 is a schematic diagram that illustrates a configuration of a coin drawing section. As illustrated in FIG. 12, the coin drawing section includes the second storing screw-type conveying member 52 and the guide section 59. An opening 7 for delivering coins toward the coin drawing port 1 is formed at the downstream edge (front edge) of the guide section 59. Furthermore, although the guide section 59 forms a conveyance path for coins, a slit 2 is formed at the entry of the conveyance path on the downstream side. Furthermore, on the downstream-side conveyance path, an outer-diameter sensor S1 that detects whether it is the outer diameter of the target type of coin to be drawn among the coins passing through the conveyance path; a material/hole sensor S2 that detects the material of a coin passing through the conveyance path and detects the presence or absence of the hole of a coin; and a counting sensor S3 that counts coins passing through the conveyance path are arranged along the guide section 59. Here, the material/hole sensor S2 is a single sensor that performs the function of a material sensor that detects the material of a coin passing through the conveyance path and the function of a hole sensor that detects the presence or absence of the hole of a coin passing through the conveyance path; however, the material sensor and the hole sensor may be separate sensors.

A coin-drawing determining unit 3 is connected to the outer-diameter sensor S1, the material/hole sensor S2, and the counting sensor S3, and it determines whether a coin passing through the slit 2 is the target type of coin to be drawn depending on whether it has an outer diameter of the target type of coin to be drawn, the material, and the presence or absence of a hole.

The slit 2 passes coins with a coin diameter equal to or less than that of the target type of coin to be drawn, stored in the coin storage 50*a*. For example, the coin storage 50*a* is the coin storage 50*a* that stores 500-yen coins, and the slit 2 is provided with an exit width for passing coins with a coin diameter equal to or less than that of 500-yen coins. Here, the slit 2 may be not only at the entry of the downstream-side conveyance path but also the entire downstream-side conveyance path. Therefore, coins with an outer diameter larger than that of the target type of coin to be drawn are stopped from being delivered at the entry of the slit 2. It is determined that coins that are stopped from being delivered at the entry of the slit 2 are coins with an outer diameter larger than that of the target type of coin to be drawn and they are a type of coins different from the target type of coin to be drawn.

A controller 4 is connected to the coin-drawing determining unit 3, gates 5, 8, and a higher-level device. If a coin is stopped from being conveyed at the entry of the slit 2, i.e., if conveyance of the second storing screw-type conveying member 52 is stopped, the controller 4 opens the gate 8 and inputs the stopped coin as a different type of coin to different-type coin storage 6. The different-type coin storage 6 is located under the coin drawing section.

If the coin-drawing determining unit 3 determines that it is not a different type of coin and it is the target type of coin to be drawn, the controller 4 controls the gate 5 so as to output the coin, output from the opening 7, to the side of the coin drawing port 1. Conversely, if the coin-drawing determining unit 3 determines that it is a different type of coin, the controller 4 controls the gate 5 so as to output the coin, output from the opening 7, to the side of the different-type coin storage 6.

Furthermore, if the coin-drawing determining unit 3 determines that it is a different type of coin, the controller 4 performs the process to cancel counting by the counting sensor S3.

Thus, as the process to determine a different type of coin by the coin-drawing determining unit 3 during coin drawing from each of the coin storages 50*a* is a process for only coins having an outer diameter equal to or less than that of the target coin to be drawn, the process is simple and coins may be drawn at a high speed.

Coin Drawing Determination of Each Coin Storage

FIG. 13 is a diagram that illustrates the details of a coin-drawing determination process by each coin storage. Furthermore, FIGS. 14 to 18 are diagrams that illustrate the details of coin-drawing determination processes and coin-drawing determination timing charts for 500-yen storage, 10-yen storage, 100-yen storage, 5-yen storage, 50-yen storage (or 1-yen storage).

Coin Drawing Determination of the 500-Yen Storage

As illustrated in FIG. 13, current coins to be drawn (target coins to be drawn) from the 500-yen storage are 500-yen nickel brass coins, 500-yen cupronickel coins, and 500-yen bi-color coins. As the diameter of 500-yen coins is 26.5 mm, the slit 2 of the coin drawing section for the 500-yen storage has an exit width of 28 mm so that coins with a coin diameter equal to or less than that of 500-yen coins can pass. Different types of coins having a coin diameter equal to or less than that of 500-yen coins and passing through the slit 2 are 10-yen bronze coins, 100-yen cupronickel coins, 100-yen clad coins, 5-yen brass coins, 50-yen cupronickel coins, and 1-yen aluminum coins, and these coins may be determined to be different types of coins when the outer-diameter sensor S1 does not detect their outer diameters.

Figure 14:
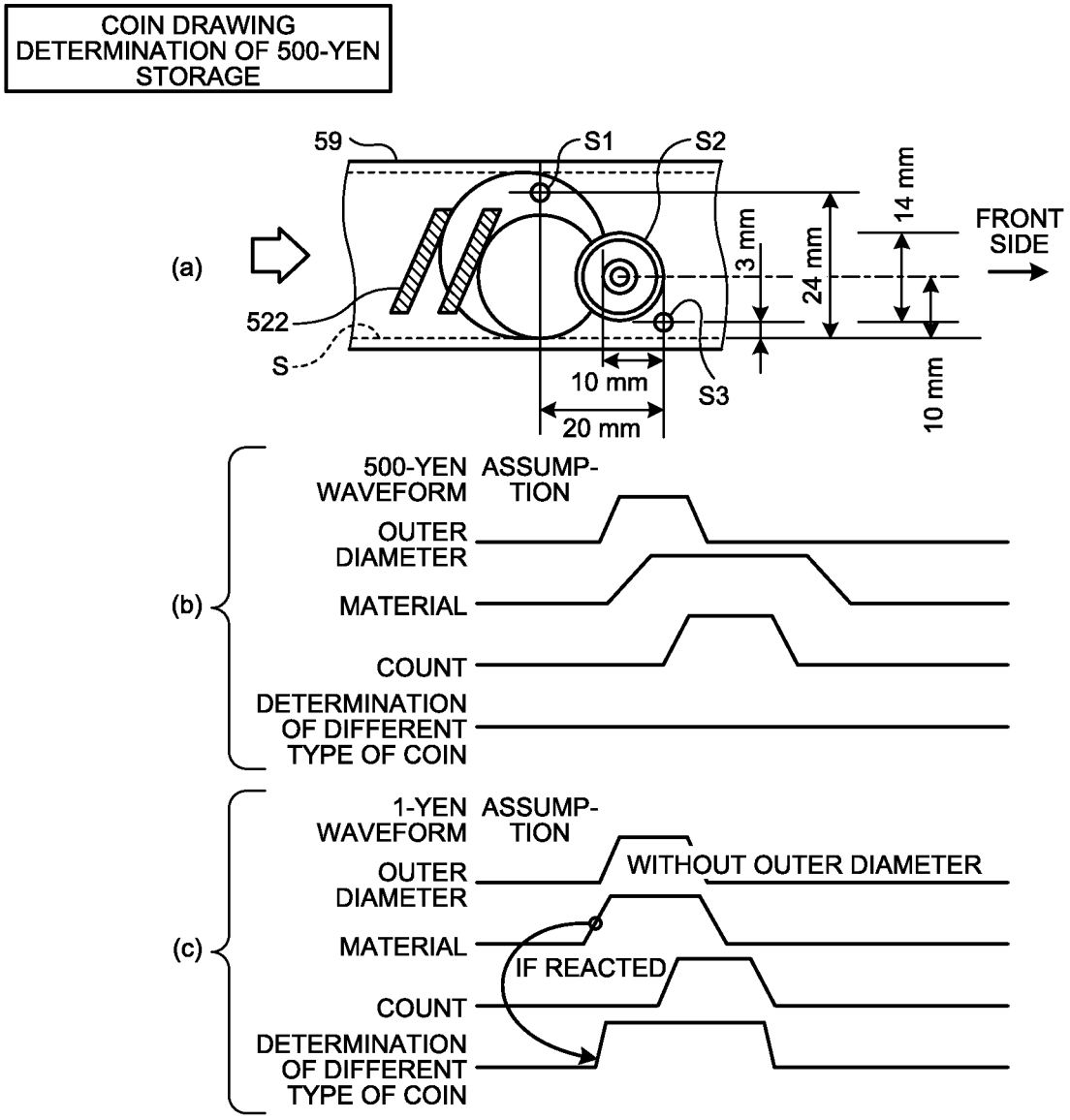
FIG. 14 is a diagram that illustrates the details of a coin-drawing determination process and a coin-drawing determination timing chart for 500-yen storage.

As illustrated in (a) of FIG. 14, the structure of the coin drawing section in the 500-yen storage is such that the downstream-side conveyance path in the coin drawing section is provided with a coin bias mechanism that biases conveyed coins to a contact surface S in one radial direction perpendicular to the conveying direction. The coin bias mechanism is a screw-like conveying mechanism, and specifically it is a second storing blade section 522 of the second storing screw-type conveying member 52. The center position of the outer-diameter sensor S1 is located away from the contact surface S by 24 mm, and only 500-yen coins with a diameter of 26.5 mm are detected. Furthermore, it is preferable that the outer-diameter sensor S1 is arranged such that it is turned on when coins with a diameter of more than 25 mm pass through it.

The material/hole sensor S2 is located at substantially the center of the conveyance path. The center position of the material/hole sensor S2 is located away from a contact surface by 10 mm, and it detects the material and the presence or absence of a hole with respect to all passing coins.

The counting sensor S3 is located near the contact surface S, specifically, the center thereof is located away from the contact surface S by 3 mm.

The material/hole sensor S2 is located downstream of the outer-diameter sensor S1 so that it is capable of starting detection when the outer-diameter sensor S1 starts detection. Furthermore, the counting sensor S3 is located downstream of the material/hole sensor S2.

As illustrated in (b) of FIG. 14, only when the passing coin is the target coin to be drawn, the outer-diameter sensor S1 is turned on. Therefore, when the outer-diameter sensor S1 is only turned on, the coin-drawing determining unit 3 does not determine that it is a different type of coin, i.e., determines that it is the target coin to be drawn.

Conversely, as illustrated in (c) of FIG. 14, if the material/hole sensor S2 is turned on while the outer-diameter sensor S1 is not on, the coin-drawing determining unit 3 determines that the passing coin is a different type of coin.

Coin Drawing Determination of 10-Yen Storage

As illustrated in FIG. 13, current coins to be drawn (target coins to be drawn) from the 10-yen storage are 10-yen bronze coins. As the diameter of 10-yen coins is 23.5 mm, the slit 2 of the coin drawing section for the 10-yen storage has an exit width of 24.7 mm so that coins with a coin diameter equal to or less than that of 10-yen coins can pass. Different types of coins having a coin diameter equal to or less than that of 10-yen coins and passing through the slit 2 are 5-yen brass coins and 1-yen aluminum coins. Furthermore, different types of coins having a different material from 10-yen coins are 100-yen cupronickel coins, 100-yen clad coins, and 50-yen cupronickel coins. Furthermore, different types of coins having a different hole from 10-yen coins are 5-yen brass coins.

Figure 15:
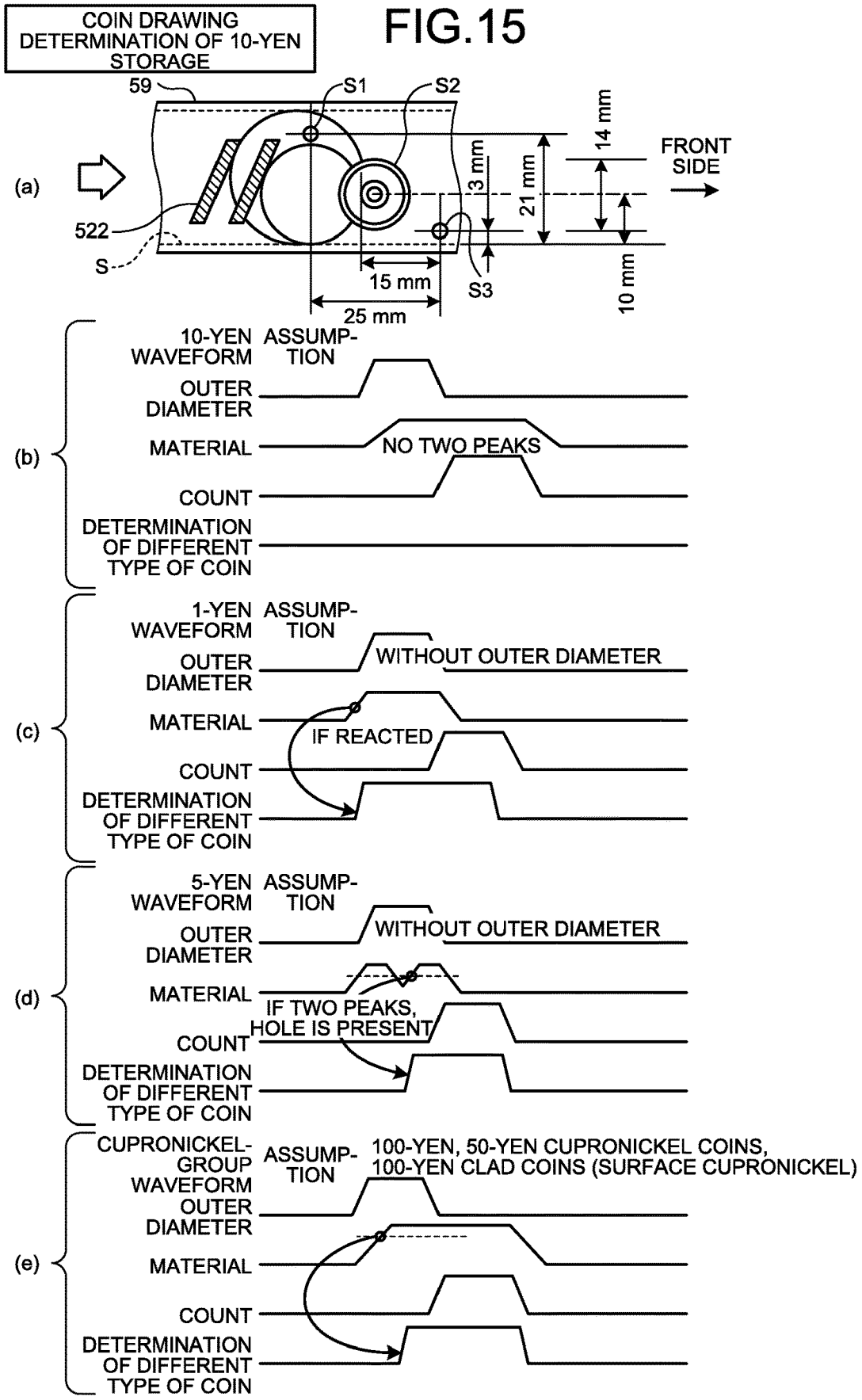
FIG. 15 is a diagram that illustrates the details of a coin-drawing determination process and a coin-drawing determination timing chart for 10-yen storage.

As illustrated in (a) of FIG. 15, although the structure of the coin drawing section for the 10-yen storage is substantially the same as the structure of the coin drawing section for the 500-yen storage, the center position of the outer-diameter sensor S1 is located away from the contact surface S by 21 mm.

As illustrated in (b) of FIG. 15, only if the passing coin is the target coin to be drawn, the outer-diameter sensor S1 is turned on, and if there are no two peaks in the ON waveform of the material/hole sensor S2, the coin-drawing determining unit 3 does not determine that it is a different type of coin, i.e., determines that it is the target coin to be drawn.

Conversely, as illustrated in (c) of FIG. 15, when the material/hole sensor S2 is turned on while the outer-diameter sensor S1 is not on, the coin-drawing determining unit 3 determines that the passing coin is a different type of coin. Different types of coins determined with such an outer diameter are, for example, 5-yen brass coins and 1-yen aluminum coins.

Furthermore, as illustrated in (d) of FIG. 15, if there are two peaks in the ON waveform of the material/hole sensor S2 while the outer-diameter sensor S1 is not on, it is determined that the coin has a hole; therefore, the coin-drawing determining unit 3 determines that the passing coin is a different type of coin. Different types of coins determined with the presence of a hole are, for example, 5-yen brass coins.

Furthermore, as illustrated in (e) of FIG. 15, if the outer-diameter sensor S1 is turned on and the level of the ON waveform of the material/hole sensor S2 is high (different), it is determined that the material is different; therefore, the coin-drawing determining unit 3 determines that the passing coin is a different type of coin. Different types of coins determined with such a material are, for example, 100-yen cupronickel coins, 100-yen clad coins, and 50-yen cupronickel coins.

Coin Drawing Determination of the 100-Yen Storage

As illustrated in FIG. 13, current coins to be drawn (target coins to be drawn) from the 100-yen storage are 100-yen cupronickel coins and 100-yen clad coins. As the diameter of 100-yen coins is 22.6 mm, the slit 2 of the coin drawing section for the 100-yen storage has an exit width of 24 mm so that coins with a coin diameter equal to or less than that of 100-yen coins can pass. As different types of coins having a coin diameter equal to or less than that of 100-yen coins and passing through the slit 2 have similar diameters, it is difficult to discriminate between them. Furthermore, different types of coins with different material from that of 100-yen coins are 5-yen brass coins, 1-yen aluminum coins, and 10-yen bronze coins. Moreover, different types of coins having a different hole from 100-yen coins are 50-yen cupronickel coins.

Figure 16:
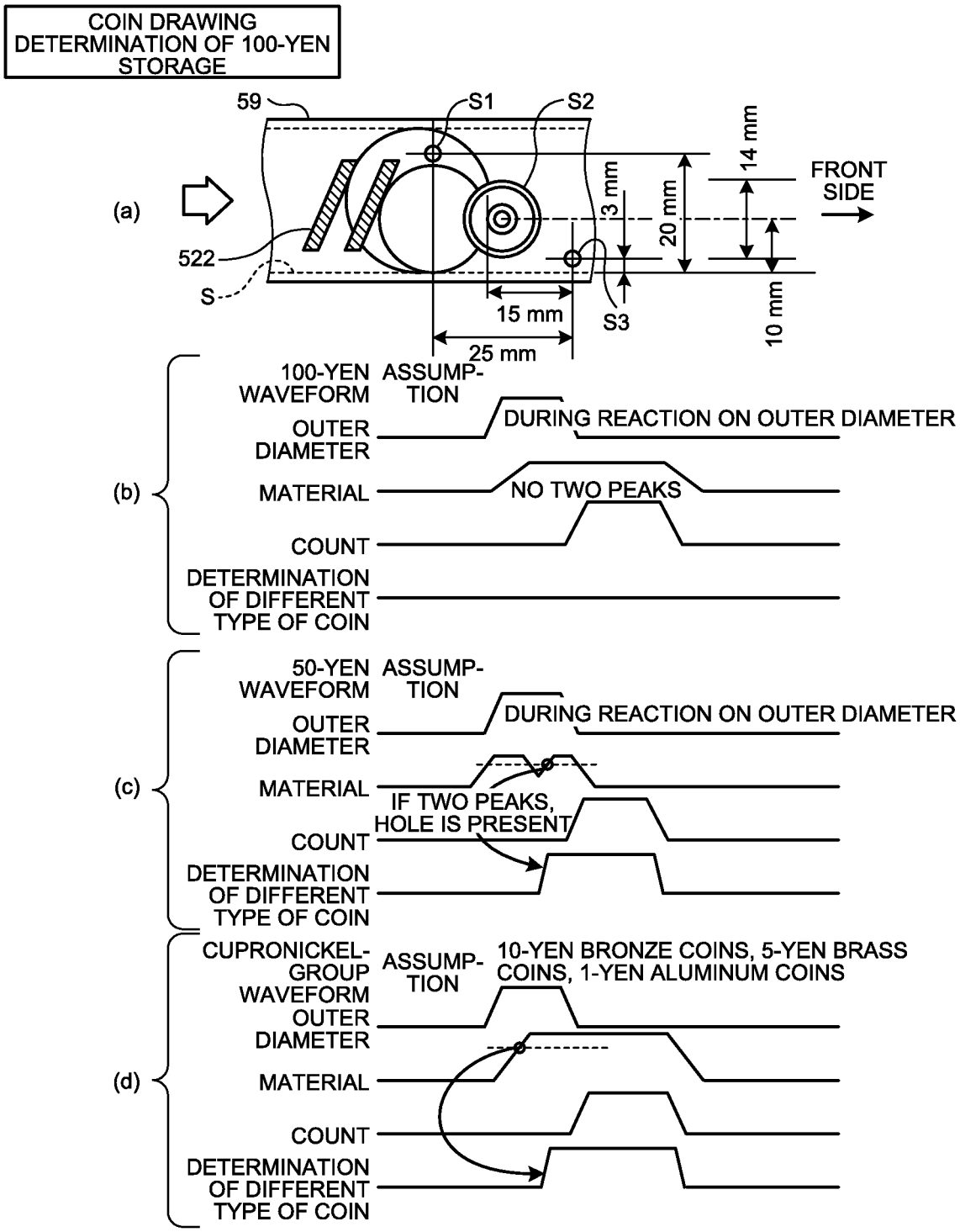
FIG. 16 is a diagram that illustrates the details of a coin-drawing determination process and a coin-drawing determination timing chart for 100-yen storage.

As illustrated in (a) of FIG. 16, although the structure of the coin drawing section for the 100-yen storage is substantially the same as the structure of the coin drawing section for the 10-yen storage, the center position of the outer-diameter sensor S1 is located away from the contact surface S by 20 mm.

As illustrated in (b) of FIG. 16, only if the passing coin is the target coin to be drawn, the outer-diameter sensor S1 is turned on and, if there are no two peaks in the ON waveform of the material/hole sensor S2, the coin-drawing determining unit 3 does not determine that it is a different type of coin, i.e., determines that it is the target coin to be drawn.

Conversely, as illustrated in (c) of FIG. 16, if there are two peaks in the ON waveform of the material/hole sensor S2 while the outer-diameter sensor S1 is on, it is determined that the coin has a hole; therefore, the coin-drawing determining unit 3 determines that the passing coin is a different type of coin. Different type of coins determined with the presence of a hole are, for example, 50-yen cupronickel coins.

Furthermore, as illustrated in (d) of FIG. 16, if the outer-diameter sensor S1 is turned on and the level of the ON waveform of the material/hole sensor S2 is high (different), it is determined that the material is different; therefore, the coin-drawing determining unit 3 determines that the passing coin is a different type of coin. Different types of coins determined with such a material are, for example, 5-yen brass coins, 1-yen aluminum coins, and 10-yen bronze coins.

Coin Drawing Determination of 5-Yen Storage

As illustrated in FIG. 13, current coins to be drawn (target coins to be drawn) from the 5-yen storage are 5-yen brass coins. As the diameter of 5-yen coins is 22 mm, the slit 2 of the coin drawing section for the 5-yen storage has an exit width of 23.2 mm so that coins with a coin diameter equal to or less than that of 5-yen coins can pass. As different types of coins having a coin diameter equal to or less than that of 5-yen coins and passing through the slit 2 have similar diameters, it is difficult to discriminate between them. Furthermore, different types of coins with different material from that of 5-yen coins are 50-yen cupronickel coins. Moreover, different types of coins having no hole, which are different from 5-yen coins, are 100-yen cupronickel coins, 100-yen clad coins, 10-yen bronze coins, and 1-yen aluminum coins.

Figure 17:
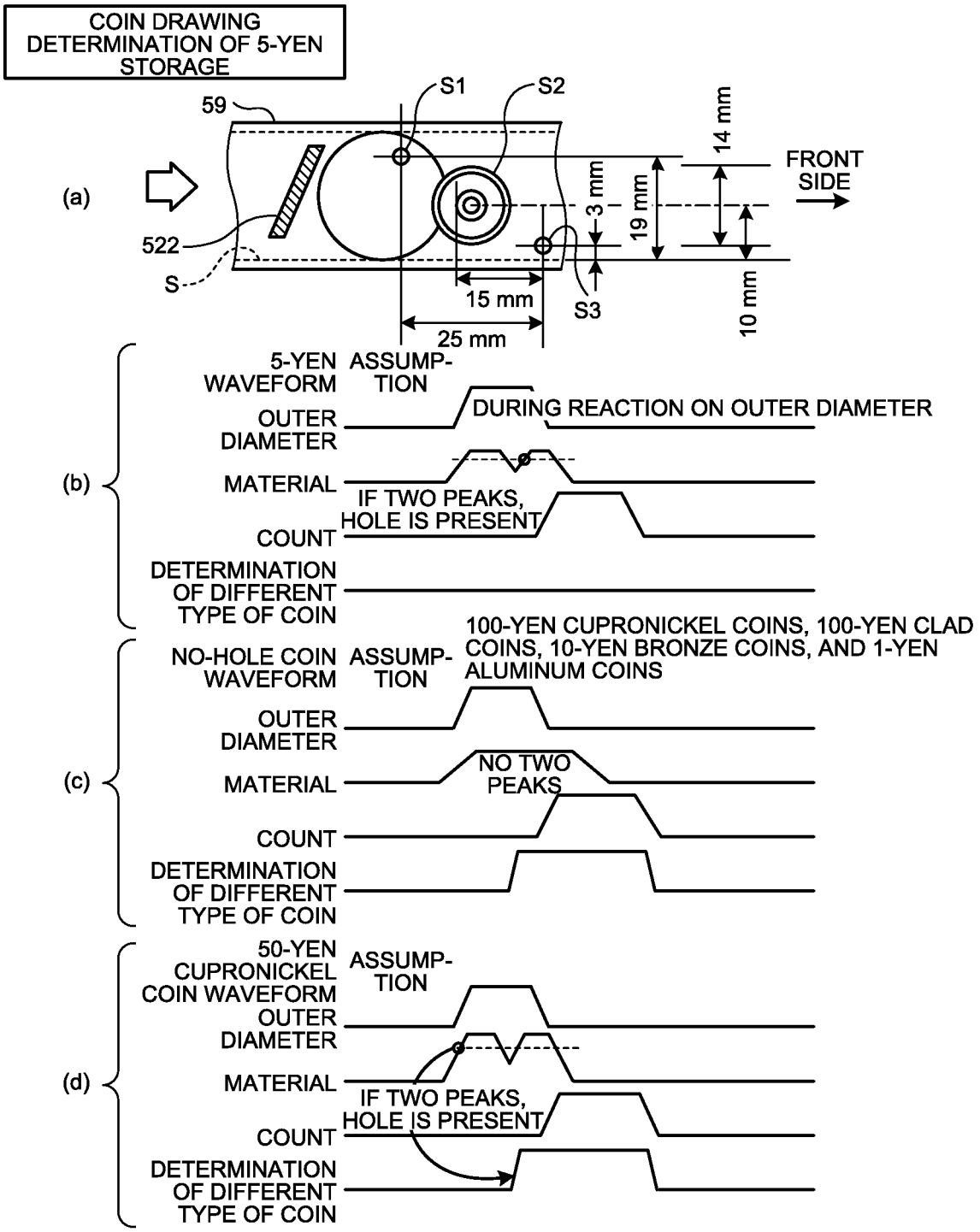
FIG. 17 is a diagram that illustrates the details of a coin-drawing determination process and a coin-drawing determination timing chart for 5-yen storage.

As illustrated in (a) of FIG. 17, although the structure of the coin drawing section for the 5-yen storage is substantially the same as the structure of the coin drawing section for the 10-yen storage, the center position of the outer-diameter sensor S1 is located away from the contact surface S by 19 mm.

As illustrated in (b) of FIG. 17, if there are two peaks in the ON waveform of the material/hole sensor S2 while the outer-diameter sensor S1 is on, it is determined that the coin has a hole; therefore, the coin-drawing determining unit 3 determines that the passing coin is the target coin to be drawn.

Conversely, as illustrated in (c) of FIG. 17, if there are no two peaks in the ON waveform of the material/hole sensor S2 while the outer-diameter sensor S1 is on, the coin-drawing determining unit 3 determines that the coin does not have a hole and it is a different type of coin. Different types of coins determined with the absence of a hole are, for example, 100-yen cupronickel coins, 100-yen clad coins, 10-yen bronze coins, and 1-yen aluminum coins.

Furthermore, as illustrated in (d) of FIG. 17, if there are two peaks in the ON waveform of the material/hole sensor S2 while the outer-diameter sensor S1 is on, it is determined that the coin has a hole; however, as the level of the ON waveform of the material/hole sensor S2 is high (different), it is determined that the material is different, and thus the coin-drawing determining unit 3 determines that the passing coin is a different type of coin. Different types of coins determined with such a material are, for example, 50-yen cupronickel coins.

Coin Drawing Determination of 50-Yen Storage and 1-Yen Storage

As illustrated in FIG. 13, current coins to be drawn (target coins to be drawn) from the 50-yen storage are 50-yen cupronickel coins. As the diameter of 50-yen coins is 21 mm, the slit 2 of the coin drawing section for the 50-yen storage has an exit width of 22.4 mm so that coins with a coin diameter equal to or less than that of 50-yen coins can pass. As different types of coins having a coin diameter equal to or less than that of 50-yen coins and passing through the slit 2 have similar diameters, it is difficult to discriminate between them. Furthermore, different types of coins with different material from that of 50-yen coins are 5-yen brass coins and 1-yen aluminum coins.

Furthermore, current coins to be drawn (target coins to be drawn) from the 1-yen storage are 1-yen aluminum coins. As the diameter of 1-yen coins is 20 mm, the slit 2 of the coin drawing section for the 1-yen storage has an exit width of 21.2 mm so that coins with a coin diameter equal to or less than that of 1-yen coins can pass. As different types of coins having a coin diameter equal to or less than that of 1-yen coins and passing through the slit 2 have similar diameters, it is difficult to discriminate between them. Furthermore, different types of coins with different material from that of 1-yen coins are 50-yen cupronickel coins.

Figure 18:
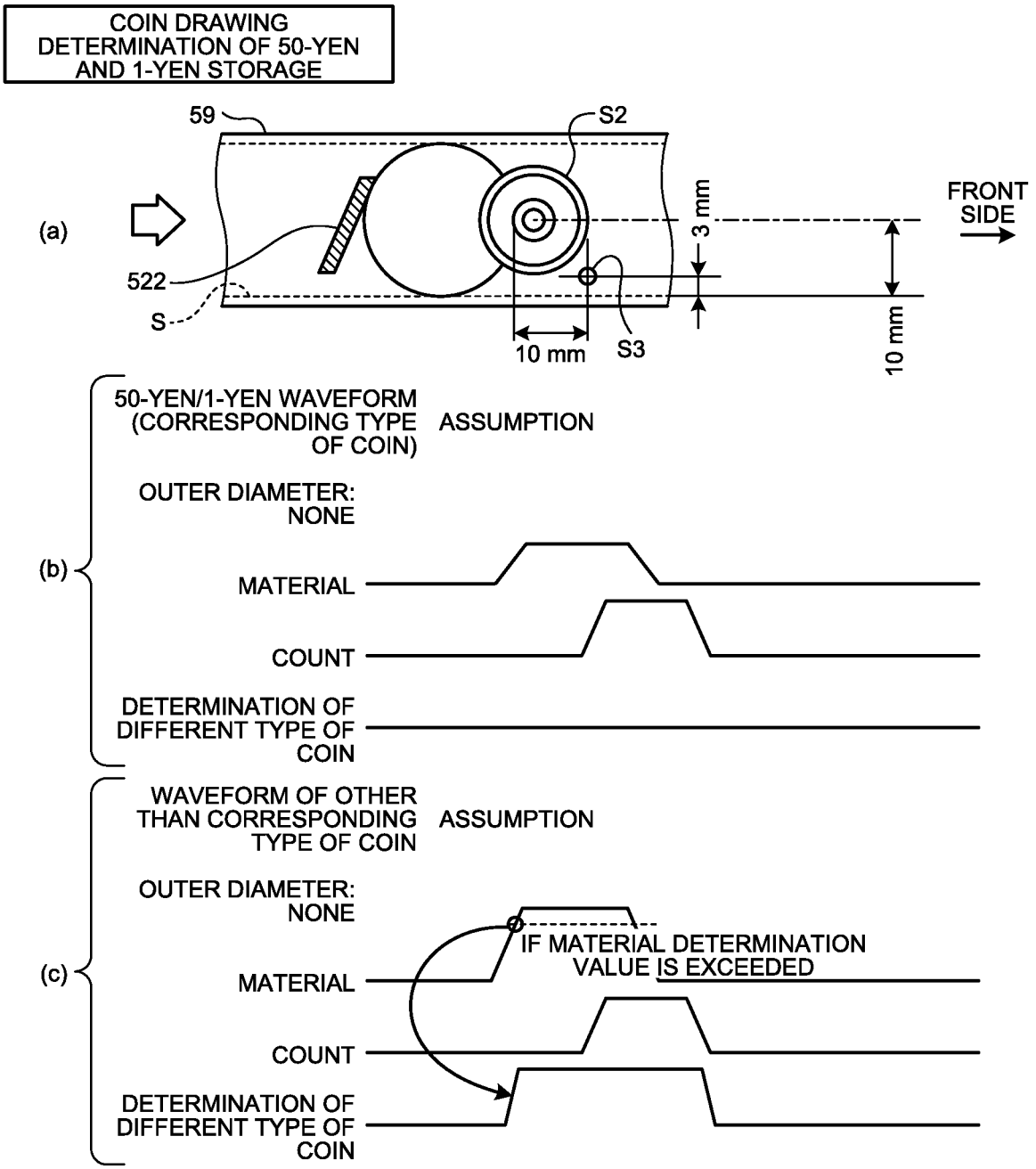
FIG. 18 is a diagram that illustrates the details of a coin-drawing determination process and a coin-drawing determination timing chart for 50-yen storage (or 1-yen storage).

As illustrated in (a) of FIG. 18, although the structures of the coin drawing sections for the 50-yen storage and the 1-yen storage are substantially the same as the structure of the coin drawing section for the 5-yen storage, the outer-diameter sensor S1 is not provided.

As illustrated in (b) of FIG. 18, if the ON waveform level of the material/hole sensor S2 is a predetermined level, the coin-drawing determining unit 3 determines that the passing coin is the target coin to be drawn.

Conversely, as illustrated in (c) of FIG. 18, if the ON waveform level of the material/hole sensor S2 exceeds the predetermined level, it is determined to be a different type of coin. Different types of coins determined with the absence of a hole are, for example, 5-yen brass coins and 1-yen aluminum coins in the case of the 50-yen storage and, for example, 50-yen cupronickel coins in the case of the 1-yen storage.

For coin drawing determination using the above-described coin drawing section, as the slit 2 is provided, different types of coins having an outer diameter larger than that of the target coin to be drawn in each of the coin storages 50*a* may be easily determined, and as the target coins to be drawn, determined by the outer-diameter sensor S1 and the material/hole sensor S2, are limited to coins equal to or smaller than the target coins to be drawn, a coin-drawing determination process is simplified. Particularly, as the outer diameter of the target coin to be drawn is smaller, there is a fewer types of coins that are targeted for a coin-drawing determination process; therefore, a process to determine coins drawn from the coin storage 50*a* is further simplified. For example, the outer-diameter sensor S1 is not necessary for determination of coins drawn from the 50-yen storage or the 1-yen storage.

Furthermore, although the coin drawing section according to the above-described embodiment uses a screw-type conveying mechanism such as the second storing screw-type conveying member 52, this is not a limitation, and for example a belt-like conveying mechanism may be used. Moreover, in the above-described coin processing apparatus, although a screw-type conveying mechanism is used as a conveying mechanism for other than the coin drawing section, other conveying mechanisms may be used.

Furthermore, the slit 2 may be provided at the rear edge of the guide section 59. In this case, the gate 8 is not necessary, and coins having an outer diameter larger than that of the target coin to be drawn returns to a coin storage again.

According to the disclosure, with a simple configuration, different types of coins may be determined with a high accuracy and at a high speed when coins are drawn from coin storages.

Additional advantages and modifications will readily occur to those skilled in the art. Therefore, the disclosure in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A coin processing apparatus that determines authenticity and a type of a received coin, sorts a coin for each type of coin after holding a coin that is determined to be a current coin, stores the sorted coin, and draws the stored coin in accordance with a coin drawing command, the coin processing apparatus comprising:

a storage configured to store the sorted coin;

a coin drawing section configured to deliver the stored coin in the storage and from which the stored coin is drawn in accordance with the coin drawing command;

a slit provided on a downstream-side conveyance path or at an entry of the downstream-side conveyance path in the coin drawing section for the storage to pass a coin having a coin diameter equal to or less than a diameter of a target type of coin to be drawn, stored in the storage;

a coin bias mechanism configured to bias a conveyed coin in one radial direction perpendicular to a conveying direction on the downstream-side conveyance path of the coin drawing section;

an outer diameter sensor configured to detect whether a coin passing through the downstream-side conveyance path has an outer diameter of a target type of coin to be drawn;

a material sensor configured to detect material of a coin passing through the downstream-side conveyance path;

a different denomination vault configured to store a coin which has been determined as different denomination;

a gate provided on a lower part of the coin drawing section, configured to open to discharge a coin from the coin drawing section;

a controller configured to, when a coin having a coin diameter greater than the diameter of the target type of coin is stopped at an entrance of the gate, open the gate to discharge the coin from the coin drawing section to the different denomination vault to discharge the coin from the coin drawing section to the different denomination vault; and a hole sensor that detects presence or absence of a hole of a coin passing through the downstream-side conveyance path, wherein a coin having an outer diameter larger than a diameter of a target type of coin to be drawn is determined not to be a target type of coin to be drawn, based on a stop of the coin at the entry of the slit, and it is determined whether the coin passing through the slit is a target type of coin to be drawn depending on whether the coin has an outer diameter of the target type of coin to be drawn, material, and presence or absence of a hole.

2. The coin processing apparatus according to claim 1, wherein the coin bias mechanism is a screw-type conveying mechanism.

3. The coin processing apparatus according to claim 2, wherein the material sensor and the hole sensor are an identical sensor.

4. The coin processing apparatus according to claim 1, wherein the material sensor and the hole sensor are an identical sensor.

* * * * *